US005088238A

United States Patent [19]

Lin

[11] Patent Number: 5,088,238

[45] Date of Patent: Feb. 18, 1992

[54] POLISHING GRINDER WITH TURBULENT FLOW OF GRINDING SOLUTION FOR GRINDING

[76] Inventor: Chao-Tong Lin, 3F, No. 1-5, Lane 101, Ta Tung S. Rd., San Chung City, Taipei Hsien, Taiwan

[21] Appl. No.: 658,153

[22] Filed: Feb. 20, 1991

[51] Int. Cl.[5] ..... B24B 31/108

[52] U.S. Cl. ..... 51/163.1; 51/164.1; 51/7

[58] Field of Search ..... 51/164.1, 163.2, 163.1, 51/313, 316, 7, 17

[56] References Cited

FOREIGN PATENT DOCUMENTS

| | | | |
|---|---|---|---|
| 3422478 | 12/1985 | Fed. Rep. of Germany | 51/163.1 |
| 0203260 | 9/1986 | Japan | 51/164.1 |
| 0899331 | 1/1982 | U.S.S.R. | 51/7 |
| 1093507 | 5/1984 | U.S.S.R. | 51/7 |
| 1313668 | 5/1987 | U.S.S.R. | 51/7 |
| 1495082 | 7/1989 | U.S.S.R. | 51/163.1 |

*Primary Examiner*—Robert A. Rose

*Attorney, Agent, or Firm*—Varndell Legal Group

[57] ABSTRACT

A grinder for polishing the outer surface of a work piece, comprising a power unit set in a machine base to carry a centrifugal disc to a centrifugalize grinding solution contained in a container for polishing work pieces therein. Elongated stop bars are longitudinally arranged on the inner wall surface of the container to stop the grinding solution centrifugalized by the centrifugal disc. Stirring bars are on the cap of the container for stirring the centrifugalized grinding solution. Stirring blades are provided on a rotary wheel, which is revolvably attached to the inner bottom of the cap, for agitating the centrifugalized grinding solution into turbulent flow so as to achieve better grinding performance.

1 Claim, 3 Drawing Sheets

POLISHING GRINDER WITH TURBULENT FLOW OF GRINDING SOLUTION FOR GRINDING

BACKGROUND OF THE INVENTION

The present invention relates to grinders, and more particularly relates to a grinder which produces turbulent flow for effectively polishing the outer surface of work or working pieces.

In the processing industry, machinery spare parts must be properly polished after the molding process. Various kinds of grinding devices have been used for this purpose. However, some special spare parts must be surface treated by use of an agitated grinding solution so that the outer surface thereof can be fully polished. There is disclosed a type of grinder which utilizies a centrifugal disc to centrifugalized a grinding solution for performing a grinding process. Because centrifugalized flow of the grinding solution is continuously rotating through the same track, the grinding effect is not satisfactory. There is another type of grinder which has been used for polishing industrial spare parts. This grinder utilizes a worm to agitate the grinding solution for grinding. A disadvantage of this type worm-acting grinder is that rapid flow of the grinding solution may cause elongated work pieces to deform. Therefore, this type of grinder is not suitable for processing elongated work pieces. There is still another type of grinder which utilizes a vibrator to produce vibration for performing the grinding process. However, this structure of grinder is still not satisfactory in use, because it produces high noise during operation and requires much time is processing.

The present invention has been accomplished to eliminate the aforesaid problems. It is therefore the main object of the present invention to provide a grinder which has means to agitate grinding solution into turbulent flow for efficiently polishing the outer surface of the working pieces placed therein. To achieve this object, there is provided a grinder which comprises a centrifugal disc driven by a power unit to centrifugalize a grinding solution contained in a container which has a plurality of elongated stop bars longitudinally made on the inner wall surface thereof to stop the centrifugalized grinding solution. The container has a cap covering its top, which cap has a plurality of stirring bars on the inner bottom thereof for stirring centrifugalized grinding solution. The cap further comprises a rotary wheel on the inner bottom thereof which has a plurality of stirring blades disposed inside the container to agitate the centrifugalized grinding solution into turbulent flow for performing the grinding process. Therefore, better grinding effect is achieved.

DETAILED DESCRIPTION OF THE PREFERRED EMBODIMENT

Referring to the annexed drawings in greater detail, therein illustrated is th preferred embodiment of the present invention which is generally comprised of a machine base 1, a centrifugal disc 2, a linkage 3 and a power unit 4.

Figure 2:
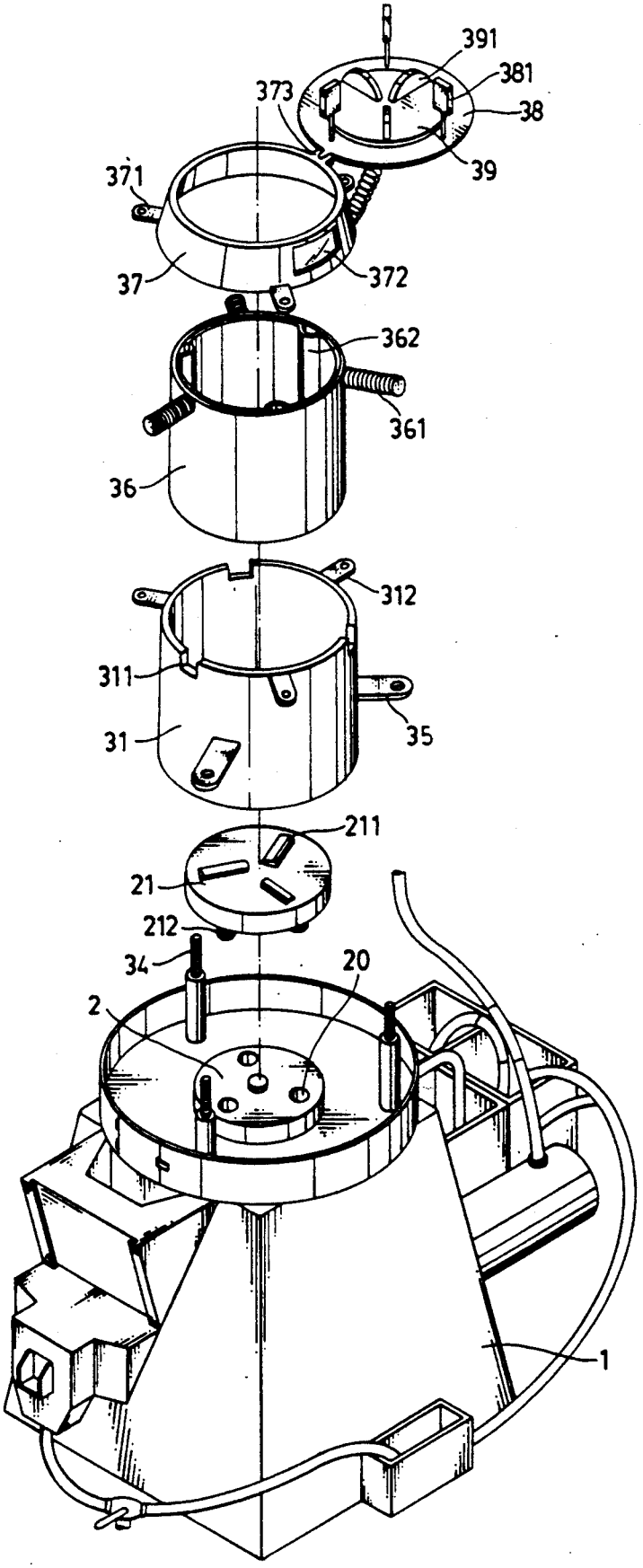
FIG. 2 is a perspective dismantled view of the centrifugal disc, the cylindrical covering, the inner cylinder, the tapered ring and the upper cap.

The machine base 1 is shaped like a truncated, rhombic pyramid having a top for mounting the centrifugal disc 2 (see FIG. 2). The power unit 4 is set inside the machine base 1 to drive the centrifugal disc 2 to rotate (see FIG. 3). Above the centrifugal disc 2 there is provided a cylindrical covering 31 controlled by the linkage 3 to alternatively move up and down.

Figure 3:
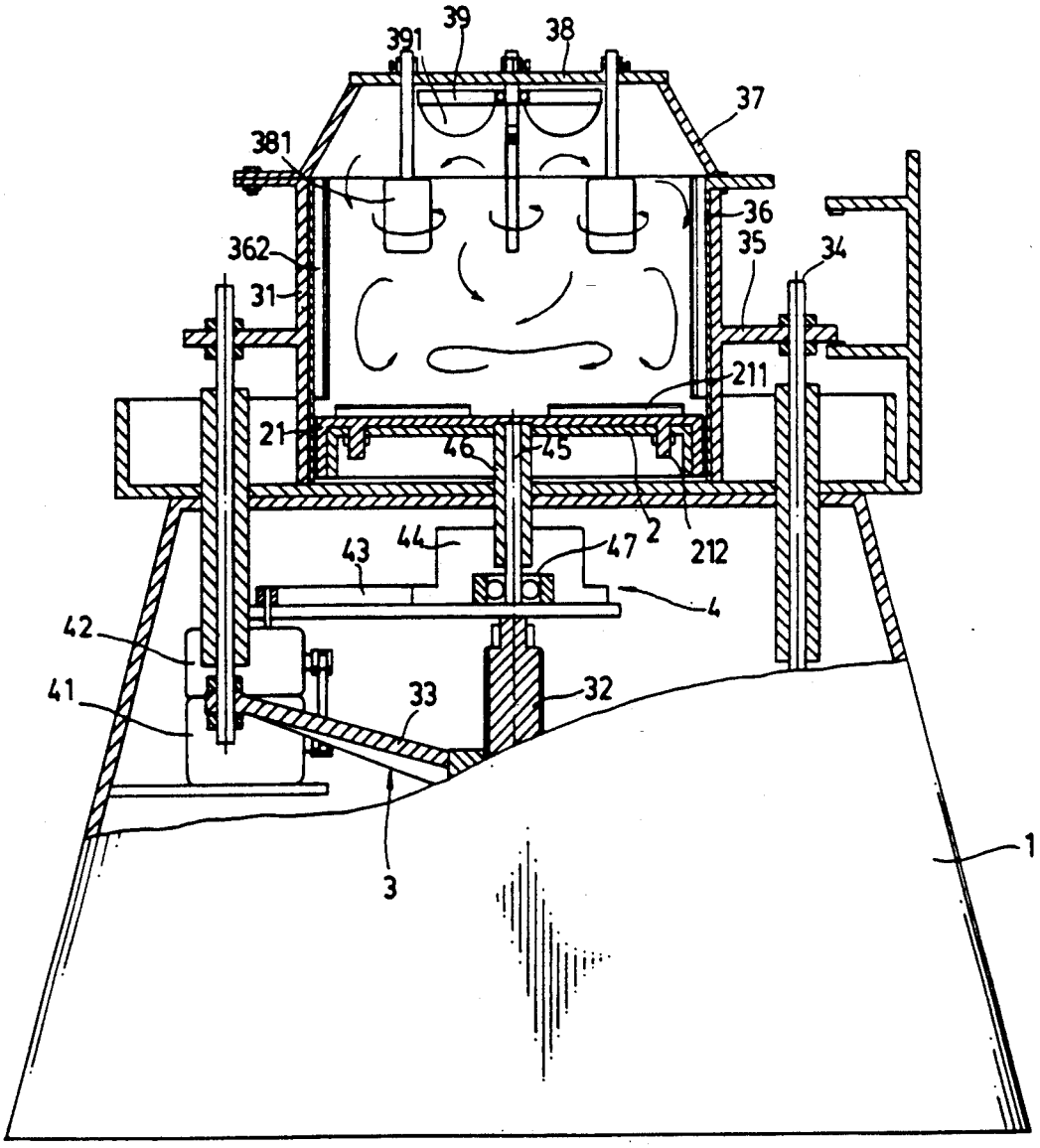
FIG. 3 is a partly sectional view thereof, illustrating the operation of the present invention.

Referring to FIG. 3, the linkage 3 includes a main screw rod 32 which is driven by a motor to alternatively rotate forwards and backwards. There is a supporting arm assembly 33 mounted on the main screw rod 32. When the main screw rod 32 is driven by the power unit 4 to rotate forwards or backwards, the supporting arm assembly 33 is forced to move upwards or downwards on the main screw rod 32. The supporting arm assembly 33 has three vertical rods 34 spaced from one another at an angle of 120° and respectively connected to the three lugs 35 on the outer wall of the cylindrical covering 31 through a screw joint. Therefore, rotating the main screw rod 32 causes the supporting arm assembly 33 to carry the cylindrical covering 31 to move upwards or downwards.

Figure 1:
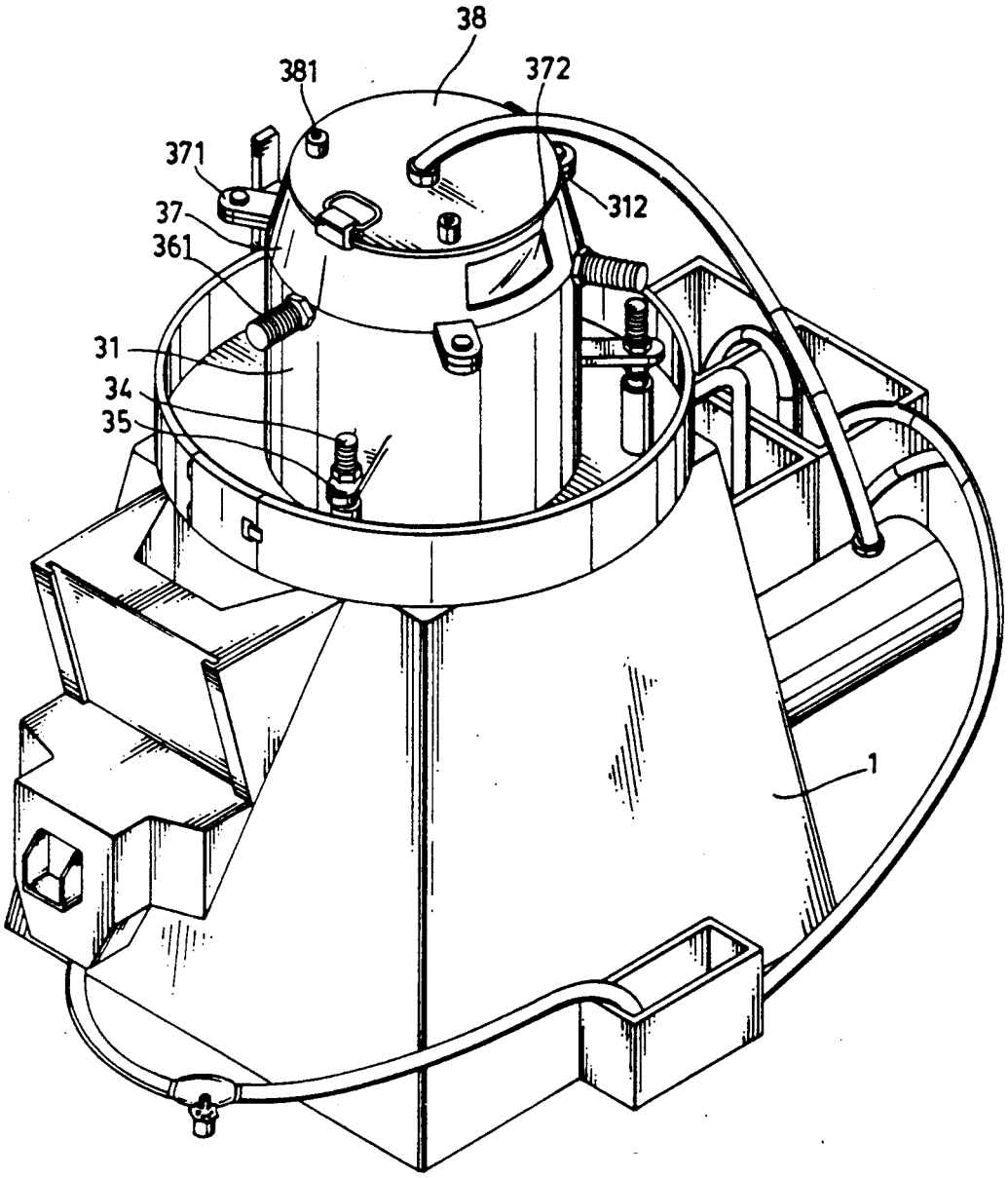
FIG. 1 illustrates the preferred embodiment of the polishing grinder of the present invention.

Referring to FIG. 1 again, the cylindrical covering 31 has three notches 311 equidistantly made around the top edge thereof, and three ribs 312 transversely projecting outwards from the top edge thereof and respectively disposed between each two of said three notches 311. Inside the cylindrical covering 31, there is provided an inner cylinder 36 which has three threaded bolts 361 transversely projecting outwards and respectively disposed at locations corresponding to the notches 311 of the cylindrical covering 31. By setting the three threaded bolts 361 in the notches 311 of the cylindrical covering 31, the inner cylinder 36 can be firmly secured inside the cylindrical covering 31 by lock nuts. The inner cylinder 36 is internally covered with a layer of PVC plastics for protection, having three semi-circular channel bars 362 equidistantly longitudinally made around the inner wall surface thereof. At the top of the inner cylinder 36, there is provided a tapered ring 37 which has three ribs 371 equidistantly transversely made around the bottom edge thereof and respectively connected to the three ribs 312 of the cylindrical covering 31 by screw means. The tapered ring 37 has a view window 372 on the outer wall thereof through which the operator can clearly see the performance of grinding process inside the inner cylinder 36. There is also provided an upper cap 38 pivotably connected to the tapered ring 37 by a hinge 373 to cover the inner cylinder 36. The upper cap 38 has a rotary wheel 39 revolvably secured to the inner bottom thereof, which rotary wheel 39 has three stirring blades 391 fixedly made thereon and equidistantly spaced from one another (i.e. at 120° interval) for stirring the solution contained in the inner cylinder 36. The upper cap 38 further comprises three stirring bars 381 equidistantly disposed around the rotary wheel 39, which stirring bars 381 are provided for stirring the solution contained in the inner cylinder 36 in another direction and can be vertically adjusted according to the depth of the solution contained in the inner cylinder 36.

The centrifugal disc 2 is mounted on the top of the machine base 1 and set inside th cylindrical covering 31, having through bolt holes 20 equiangularly made thereon at the top for mounting a lining board 21 which is made from PVC plastics and provided to protect the centrifugal disc 2 against friction or damage. The lining board 21 has three threaded bolts 212 vertically disposed at the bottom and respectively fastened in the bolt holes 20 of the centrifugal disc 2, and a plurality of elongated, raised strips 211 radially made on the top edge thereof. When the centrifugal disc 2 is driven by the power unit 4 to rotate, the raised strips 211 of the lining board 21 are carried to centrifugalize the solution contained in the inner cylinder 31.

Referring to FIG. 3 again, the power unit includes a motor 41 controlled by a speed reducer 42 to drive a gear set 44 to carry a driving shaft 45 to rotate on two opposite bearings 46 and 47 via a chain 43. By means of the operation of the gear set 44, the driving shaft 45 is driven to carry the centrifugal disc 2 to rotate.

Operation of the present invention is outlined hereinafter. Before operation, the upper cap 38 is opened for placing work pieces, grinding particles, grinding compound and solution into the inner cylinder 36. After the upper cap 38 is closed, the motor 41 of the power unit 4 is turned on to drive the driving shaft 45 to carry the centrifugal disc 2 to rotate. Rotation of the centrifugal disc 2 causes the raised strips 211 to centrifugalize the solution contained in the inner cylinder 31. Because of the effect of the channel bars 363, the centrifugalized flow of solution in the inner cylinder 36 is agitated to flow into all directions. At the same time, the stirring blades 391 of the rotary wheel 39 and the stirring bars 381 of the upper cap 38 are rotated to stir the centrifugalized flow of solution into turbulent. Therefore, better grinding effect is achieved through the present invention.

I claim:

1. A grinder comprising a power unit set inside a base, said power unit comprising a container a motor controlled by a speed reducer, a driving shaft driver by said motor a centrifugal disc carried by said shaft to centrifugalize grinding solution contained in said container for polishing work pieces therein, and characterized in that:

said centrifugal disc has a top with three elongated, raised strips radially disposed thereon for centrifugalizing said grinding solution contained in said container;

said container has an inner wall surface and a top opening, three elongated semi-circular channel bars equidistantly and longitudinally formed on said inner wall surface thereof for interrupting the movement of said grinding solution centrifugalized by said centrifugal disc and an upper cap pivotably connected thereto for covering said top opening, said upper cap having an inner bottom and a rotary wheel rotatably secured to said inner bottom, said rotary wheel having three stirring blades fixed thereon and equidistantly spaced from one another for stirring said grinding solution contained in said container, and three stirring bars equidistantly disposed on said upper cap around said rotary wheel for stirring said grinding solution contained each of in said container, said stirring bars rotatable about a respective stationary axis and respectively adjustable in a vertical position.

* * * * *